US010407968B2

(12) United States Patent
Kumar et al.

(10) Patent No.: US 10,407,968 B2
(45) Date of Patent: Sep. 10, 2019

(54) SYSTEM AND METHOD FOR OPERATING VEHICLE DOOR

(71) Applicant: FARADAY & FUTURE INC., Gardena, CA (US)

(72) Inventors: Padmanabhan Kumar, Ranchos Palos Verdes, CA (US); Matthew Partsch, San Pedro, CA (US); Cian Brogan, Franklin, MI (US); Stewart Taylor, Los Gatos, CA (US)

( * ) Notice: Subject to any disclaimer, the term of this patent is extended or adjusted under 35 U.S.C. 154(b) by 398 days.

(21) Appl. No.: 15/417,330

(22) Filed: Jan. 27, 2017

(65) Prior Publication Data

US 2017/0234054 A1 Aug. 17, 2017

Related U.S. Application Data

(60) Provisional application No. 62/289,119, filed on Jan. 29, 2016.

(51) Int. Cl.
*E05F 15/659* (2015.01)
*E05F 15/73* (2015.01)
*E05F 15/40* (2015.01)

(52) U.S. Cl.
CPC ..... *E05F 15/73* (2015.01); *E05F 15/40* (2015.01); *E05Y 2400/53* (2013.01); *E05Y 2900/531* (2013.01)

(58) Field of Classification Search
CPC ..... E05F 15/00
USPC ..... 318/466–468
See application file for complete search history.

(56) References Cited

U.S. PATENT DOCUMENTS

| | | | | |
|---|---|---|---|---|
| 5,902,941 | A * | 5/1999 | Gabiniewicz | G01L 19/00 73/865.6 |
| 6,062,079 | A * | 5/2000 | Stewart | G01P 3/68 73/488 |
| 6,278,376 | B1 | 8/2001 | Calamatas | |
| 7,357,093 | B2 * | 4/2008 | Potter | B63G 8/32 114/238 |
| 2013/0144495 | A1 * | 6/2013 | Yu | E05F 15/70 701/49 |

OTHER PUBLICATIONS

Machine translation of Chinese Office Action dated May 16, 2018 for application No. 201710063590.6, a counterpart application to U.S. Appl. No. 15/417,330, 8 pages.

* cited by examiner

*Primary Examiner* — Bentsu Ro
(74) *Attorney, Agent, or Firm* — Veros Legal Solutions, LLP

(57) ABSTRACT

A system for operating a door of a vehicle is disclosed. The system may include an actuator configured to move the door between an open position and a closed position. The system may also include a controller configured to determine a first open-door angle associated with a predetermined first velocity profile, determine a second open-door angle based on the open position relative to the closed position, determine a second velocity profile based on the first open-door angle, the second open-door angle, and the first velocity profile, and control the actuator to operate the door according to the second velocity profile.

20 Claims, 6 Drawing Sheets

500

SYSTEM AND METHOD FOR OPERATING VEHICLE DOOR

CROSS-REFERENCE TO RELATED APPLICATIONS

This application claims the benefit of U.S. Provisional Application No. 62/289,119, filed on Jan. 29, 2016. The subject matter of the aforementioned application is incorporated herein by reference.

TECHNICAL FIELD

The present disclosure generally relates to systems and methods for operating a vehicle door, and more specifically relates to systems and methods for controlling the movement of a vehicle door based on a velocity profile.

BACKGROUND

A vehicle door is usually equipped with a handle. Such a handle is often located below the outer belt line of the door and allows people to manually open the doors. Although this arrangement may be easy to implement, there are some shortcomings. For example, an operator may have to carefully move the door in order to avoid the contact between the door and an object in the vicinity of the vehicle (for example, another vehicle next to the vehicle), which may cause damage to the door and/or the object. Therefore, it may be desirable to detect one or more objects that may be in the path of a door when it is moved to an open position.

Doors that open and close automatically, also referred to as powered doors, may not require a user to pull or push them open, and instead may rely on one or more actuators to open and close the door. Sometimes, when an actuator is opening or closing a door, the door will shake or jitter, which may be undesirable. Therefore, it may be desirable to control operation of one or more actuators such that the door does not shake or jitter when opening and/or closing the door.

SUMMARY

One aspect of the present disclosure is directed to a system for operating a door of a vehicle. The system may include an actuator configured to move the door between an open position and a closed position (e.g., from a closed position to an open position, or from an open position to a closed position). The system may also include a controller configured to determine a first open-door angle associated with a predetermined first velocity profile, determine a second open-door angle based on the open position relative to the closed position, determine a second velocity profile based on the first open-door angle, the second open-door angle, and the first velocity profile, and control the actuator to operate the door according to the second velocity profile.

Another aspect of the present disclosure is directed to a method for operating a door of a vehicle. The method may include determining, by a controller, a first open-door angle associated with a predetermined first velocity profile, and determining, by the controller, a second open-door angle based on the open position relative to the closed position. The method may further include determining, by the controller, a second velocity profile based on the first open-door angle, the second open-door angle, and the first velocity profile, and operating the door, by an actuator, according to the second velocity profile.

Yet another aspect of the present disclosure is directed to a vehicle that includes a door. The vehicle may also include an actuator configured to move the door between an open position and a closed position. The vehicle may further include a controller configured to determine a first open-door angle associated with a predetermined first velocity profile, determine a second open-door angle based on the open position relative to the closed position, determine a second velocity profile based on the first open-door angle, the second open-door angle, and the first velocity profile; and control the actuator to operate the door according to the second velocity profile.

DETAILED DESCRIPTION

The disclosure is directed to a system and method for opening and closing a vehicle door. The vehicle on which the system and method may be implemented, may be an electric vehicle, a fuel cell vehicle, a hybrid vehicle, a conventional internal combustion engine vehicle, or combinations thereof. The vehicle may have any body style, such as a sports car, a coupe, a sedan, a pick-up truck, a station wagon, a sports utility vehicle (SUV), a minivan, or a conversion van. The vehicle may be configured to be operated by an operator, occupying the vehicle, or remotely controlled, and/or it may be autonomous.

In some embodiments, the system may be configured to open or close a door of the vehicle in different modes based on an operator's input. For example, the system may operate in a powered mode, in which at least a part of the opening or closing is performed by one or more actuators controlled by a controller. The system may also include a sensor to detect an object that is within a vicinity of a portion of a door. The system may further create a velocity profile configured to control the speed at which the door opens and closes, and prevent the door from coming into contact with an object. The velocity profile may be used to determine an amount of current an actuator draws at a particular time during the opening or closing of a door. It may be derived based on where an object it located within a projected path of a moving door when the door is moving from a closed position to an open position (e.g., such that the opening door does not contact the object located within the projected path.

A velocity profile may be dynamically generated based on a variety of factors including, but not limited to: a first open-door angle (e.g., a maximum angle through which a door pivots relative to a closed position, which may also be referred to as a maximum angle that a vehicle's door can be opened), the location of an object outside of a vehicle (e.g., another vehicle or a shopping cart), a second open-door angle (e.g., either a current angle of an open door before closing the door, or an angle that a vehicle's door can be opened from a closed position without contacting an object outside of a vehicle), and/or a total time to fully open or close a door. A velocity profile may also include a ramp-up time to open or close a door, and a ramp-down time to open or close a door. The ramp-up time and the ramp-down time may be times during the movement of a door where the velocity of a moving door increases (e.g., when the door begins moving) or decreases (e.g., when the door is about to stop moving). Ramp-up times and ramp-down times prevent a powered door from opening very quickly or closing very quickly, potentially injuring a user.

Figure 1:
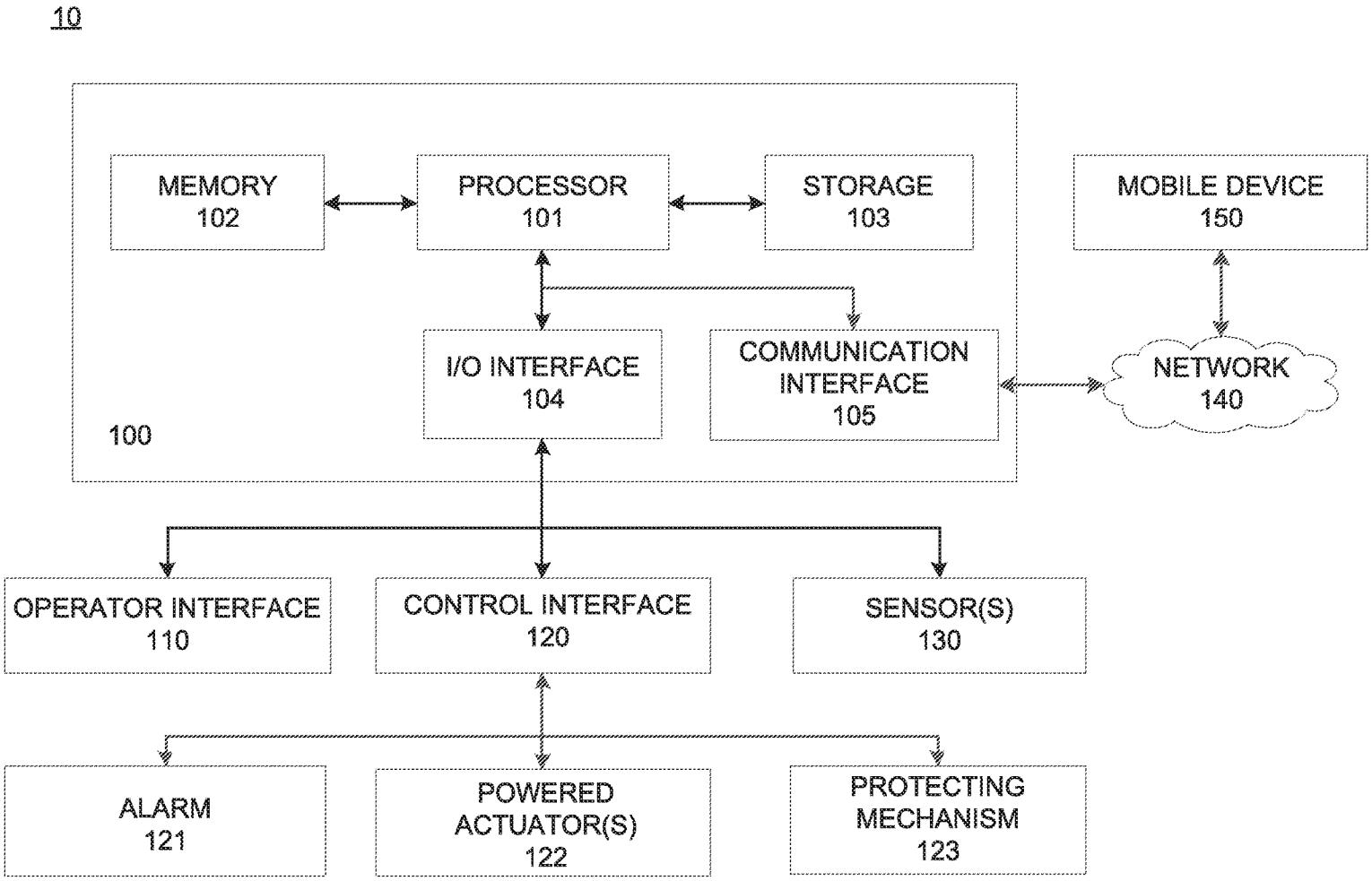
FIG. 1 is a block diagram of an exemplary system for operating a vehicle door.

FIG. 1 shows a block diagram of an exemplary system 10 for opening and closing a door of a vehicle. As illustrated in FIG. 1, system 10 may include a controller 100, an operator interface 110, a control interface 120, and one or more sensors 130. System 10 may also include an alarm 121 configured to generate an audio, visual, or display alert under certain circumstances. System 10 may further include one or more actuators 122 configured to open or close the doors of the vehicle. In some embodiments, actuator(s) 122 may be powered. Actuators 122 may be one of a linear actuator or a motor configured to cause a door to move to a destination position determined by controller 100. For example, actuators 122 may be electrically, hydraulically, and/or pneumatically powered. Other types of actuators are contemplated. In some embodiments, system 10 may also include a protecting mechanism 123 configured to resist movement of the doors under certain circumstances.

Controller 100 may have, among other things, a processor 101, memory 102, storage 103, an I/O interface 104, and/or a communication interface 105. At least some of these components of controller 100 may be configured to transfer data and send or receive instructions between or among each other. At least some of these components of controller 100 may be configured to generate a velocity profile for movement of the doors.

Processor 101 may be configured to receive signals from components of system 10 and process the signals to determine one or more conditions of the operations of system 10. Processor 101 may also be configured to generate and transmit a control signal in order to actuate one or more components of system 10. For example, processor 101 may determine a velocity profile, for example, by detecting the location of an object outside of a vehicle using one or more sensors 130. Processor 101 may also generate various portions of a velocity profile that may generate the control signal. For example, processor 101 may generate portions of a velocity profile based on various inputs such as a first open-door angle, a second open-door angle, a ramp-up time percentage of total time to open or close a door, a ramp-down time percentage of total time to open or close a door, and a total time to fully open or close a door. Using these inputs, processor 101 may be used to determine a ramp-up time, a ramp-down time, a time to begin ramping down, a target time to open or close a door, and a target velocity. These determinations are described below in further detail (e.g., with reference to FIG. 5).

In operation, according to some embodiments, processor 101 may execute computer instructions (program codes) stored in memory 102 and/or storage 103, and may perform exemplary functions in accordance with techniques described in this disclosure. Processor 101 may include or be part of one or more processing devices, such as, for example, a microprocessor. Processor 101 may include any type of a single or multi-core processor, a mobile device, a microcontroller, a central processing unit, a graphics processing unit, etc.

Memory 102 and/or storage 103 may include any appropriate type of storage provided to store any type of information that processor 101 may use for operation. Memory 102 and storage 103 may be a volatile or non-volatile, magnetic, semiconductor, tape, optical, removable, non-removable, or other type of storage device or tangible (i.e., non-transitory) computer-readable medium including, but not limited to, a ROM, a flash memory, a dynamic RAM, and a static RAM. Memory 102 and/or storage 103 may also be viewed as what is more generally referred to as a "computer program product" having executable computer instructions (program codes) as described herein. Memory 102 and/or storage 103 may be configured to store one or more computer programs that may be executed by processor 101 to perform exemplary functions disclosed in this application. Memory 102 and/or storage 103 may be further configured to store data used by processor 101. For example, memory 102 and/or storage 103 may be configured to store parameters for controlling one or more actuators 122, including, for example, the distances that a door may travel during movement and/or the maximum angle through which the door may pivot. Memory 102 and/or storage 103 may also be configured to store the inputs used by processor 101 in determining velocity profiles as described herein. For example, memory 102 and/or storage 103 may store a first open-door angle, a ramp-up percentage of total time to open or close a door, a ramp-down percentage of total time to open or close a door, and a total time to fully open or close a door. It should be appreciated that a total time to fully open or close a door may be the time it takes for a powered door to move from a closed position to a position where the door is open at a first open-door angle (e.g., completely open), and a target time to open or close a door may be the time it takes for a powered door to move from a first position where the door is at a particular angle to a second open-door angle (e.g., from closed to partially open or from partially open to closed). Memory 102 and/or storage 103 may also store information acquired by one or more sensors 130, and the second open-door angle.

I/O interface 104 may be configured to facilitate the communication between controller 100 and other components of system 10. I/O interface 104 may also receive signals from one or more sensors 130, and send the signals to processor 101 for further processing. I/O interface 104 may also receive one or more control signals from processor 101, and send the signals to control interface 120, which may be configured to control the operations of one or more sensors 130, one or more actuators 122, protecting mechanism 123, and/or alarm 121. In some embodiments, I/O interface 104 may be configured to receive parameters associated with generating a velocity profile, such as a time to fully open or close a door, a ramp-up time percentage of total time to open or close a door, and/or a ramp-down time percentage of total time to open or close a door. A ramp-up time percentage of total time to open or close a door may be a percentage of an amount of time that actuator 122 takes to open or close a door (e.g., total time to fully open or close or target time to open or close). Similarly, a ramp-down time percentage of total time to open or close a door may be a percentage of an amount of time that actuator 122 takes to open or close a door.

Communication interface 105 may be configured to transmit and receive data with, among other devices, one or more mobile devices 150 over a network 140. For example, communication interface 105 may be configured to receive from mobile device 150 a signal indicative of unlocking a door. Communication interface 105 may also transmit the signal to processor 101 for further processing.

Operator interface 110 may be configured to generate a signal for locking, unlocking, opening, or closing the door in response to an action by an operator (e.g., a driver, a passenger, or an authorized person who can access the vehicle or open or close the vehicle door). Exemplary action by the operator may include a touch input, gesture input (e.g., hand waving, etc.), a key stroke, force, sound, speech, face recognition, finger print, hand print, or the like, or a combination thereof. In some embodiments, operator interface 110 may also be configured to activate or deactivate the vehicle in response to the operator's action. Operator interface 110 may also generate a signal based on the operator's action, and transmit the signal to controller 100 for further processing.

Operator interface 110 may be located on the interior side of the door and/or other component(s) inside the vehicle. Operator interface 110 may be part of or located on the exterior of the vehicle, such as, for example, an outer belt, an A-pillar, a B-pillar, a C-pillar, and/or a tailgate. Additionally or alternatively, operator interface 110 may be located on the interior side of the door and/or other component(s) inside the vehicle. For example, operator interface 110 may be part of or located on the steering wheel, the control console, and/or the interior side of the door (not shown). In some embodiments, operator interface 110 may be located on or within parts connecting the door and the locking mechanism of the vehicle. Operator interface 110 may sense a force pushing the door exerted by the operator inside or outside the vehicle, and generate a signal based on the force. For example, operator interface 110 may be a pull handle, a button, a touch pad, a key pad, an imaging sensor, a sound sensor (e.g., microphone), a force sensor, a motion sensor, or a finger/palm scanner, or the like, or a combination thereof. Operator interface 110 may be configured to receive an input from the operator. Exemplary input may include a touch input, gesture input (e.g., hand waving, etc.), a key stroke, force, sound, speech, face recognition, finger print, hand print, or the like, or a combination thereof. Operator interface 110 may also generate a signal based on the received input and transmit the signal to controller 100 for further processing.

Control interface 120 may be configured to receive a control signal from controller 100 for controlling, among other devices, sensor(s) 130, alarm 121, actuator(s) 122, and/or protecting mechanism 123. Control interface 120 may also be configured to control sensor(s) 130, alarm 121, actuator(s) 122, and/or protecting mechanism 123 based on the control signal.

Sensor 130 may be located on the exterior of the door or vehicle, the interior side of the door, or inside the vehicle. Sensor 130 may include one or more sensors (e.g., sensors 132, 134, and/or 136 illustrated in FIG. 2) configured to determine a distance between an object outside the vehicle and at least a portion of the vehicle. In some embodiments, sensors 130, 132, 134, and/or 136 may include a sensor configured to emit light such as visible, UV, IR, RADAR, LiDAR, and other useful frequencies for irradiating the surface of the surrounding object(s) and measuring the distance of such object(s) from the door based on the reflected light received. In some embodiments, sensors 130, 132, 134, and/or 136 may include an ultrasonic sensor configured to emit ultrasonic signals and detect object(s) based on the reflected ultrasonic signals. Other types of sensors for determining the distance between an object and a portion of the vehicle are contemplated.

According to some embodiments, mobile device 150 may be configured to generate a signal indicative of activating or deactivating the vehicle. In some embodiments, mobile device 150 may be configured to generate a signal indicative of locking, unlocking, opening, or closing a door in response to the operator's input. For example, mobile device 150 may transmit the signal to system 10 over network 140. Network 140 may be any type of wired or wireless network that may allow transmitting and receiving data. For example, network 140 may be wired, a local wireless network (e.g., Bluetooth™, WiFi, near field communication (NFC), etc.), a cellular network, or the like, or a combination thereof. Other network types are contemplated.

Mobile device 150 may be any type of a general purpose computing device. For example, mobile device 150 may include a smart phone with computing capacity, a tablet, a personal computer, a wearable device (e.g., Google Glass™ or smart watches, and/or affiliated components), or the like, or a combination thereof. In some embodiments, a plurality of mobile devices 150 may be associated with selected persons. For example, mobile devices 150 may be associated with the owner(s) of the vehicle, and/or one or more authorized people (e.g., friends or family members of the owner(s) of the vehicle).

Figure 2:
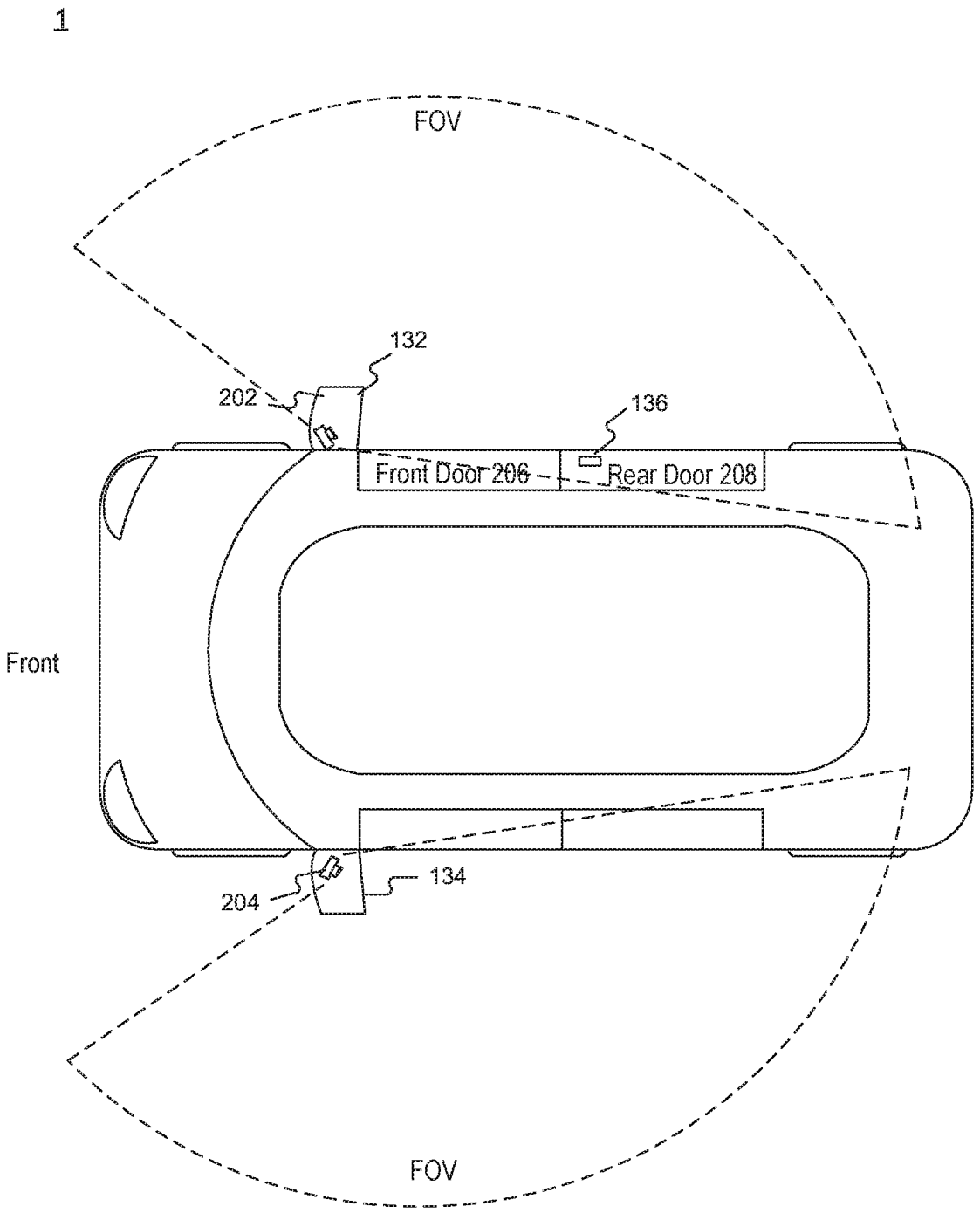
FIG. 2 is a schematic top view of an exemplary vehicle configured to implement the exemplary system of FIG. 1.

FIG. 2 shows a schematic top view of an exemplary vehicle 1 configured to implement system 10 according some embodiments disclosed herein. As illustrated in FIG. 2, vehicle 1 may include two side mirrors 202 and 204, on which sensors 130, 132, 134, and/or 136 may be located. Although FIG. 2 shows two sensors 132 and 134 located on the side mirrors 202 and 204, vehicle 1 may have more sensors located on the exterior of the door or vehicle, the interior side of the door, or inside the vehicle. Vehicle 1 may also include a front door 206 and a rear door 208. Additional sensor 136 may be located on rear door 208. Although FIG. 2 shows one sensor 136 located on rear door 208, it is contemplated that vehicle 1 may have more sensor(s) located on the exterior of doors 206, 208, or vehicle 1, the interior side of the doors, or inside vehicle 1.

Figure 3:
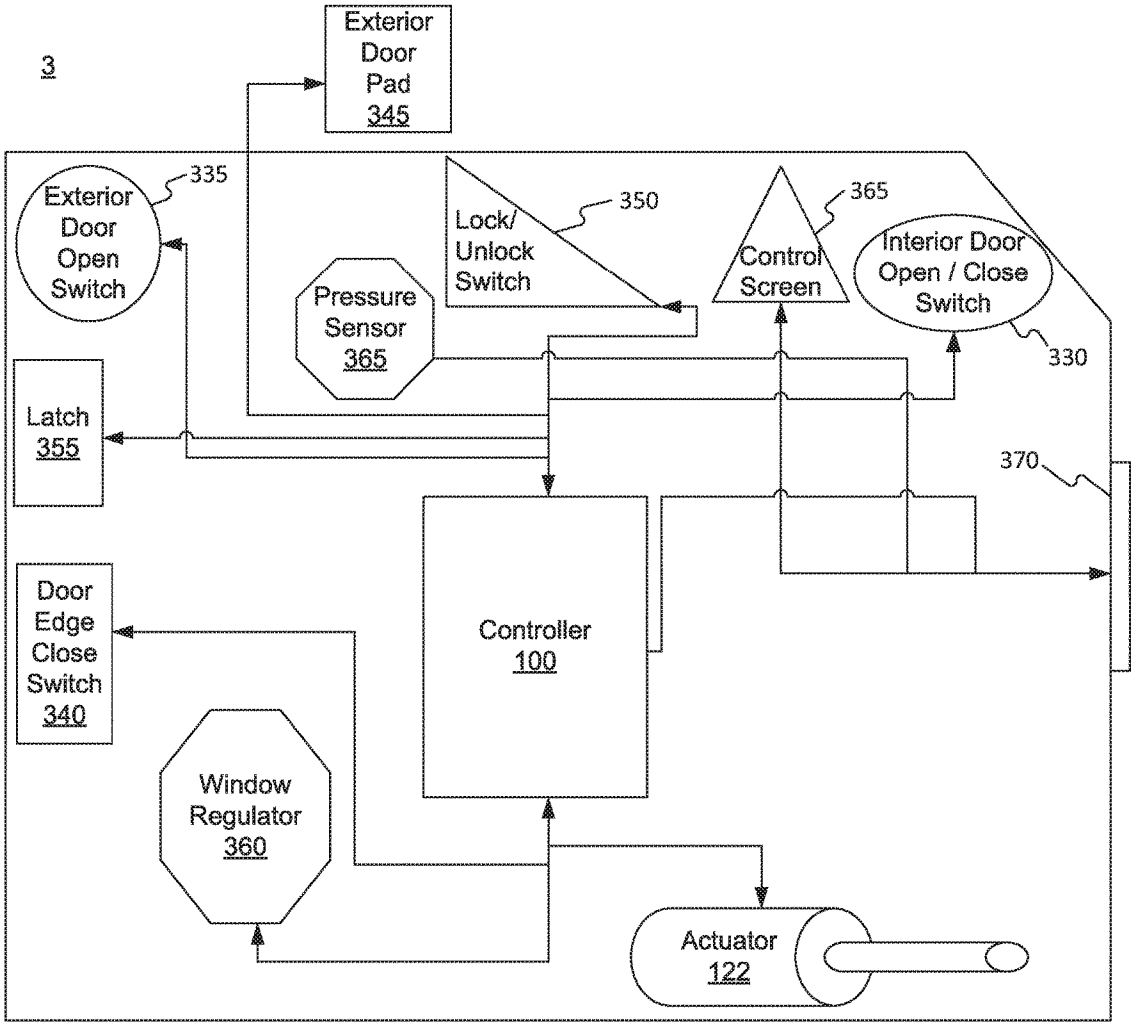
FIG. 3 is a schematic side view of an exemplary vehicle door configured to implement the exemplary system of FIG. 1.

FIG. 3 is a schematic side view of an exemplary vehicle door 3 configured to implement system 10 of FIG. 1. Vehicle door 3 may include controller 100, actuator 122, and various other components. For example, vehicle door 3 may also include an interior door open/close switch 330, an exterior door open switch 335, a door edge close switch 340, an exterior door pad 345, a lock/unlock switch 350, a latch 355, a window regulator 360, a pressure sensor 365, a control screen 365, and/or an interface 370 that may communicatively couple components included in vehicle door 3 to the vehicle. Controller 100 may be included solely within vehicle door 3, it may be included in one or more of vehicle door 3, and/or in a computing device included in a vehicle but not in vehicle door 3.

Figure 4:
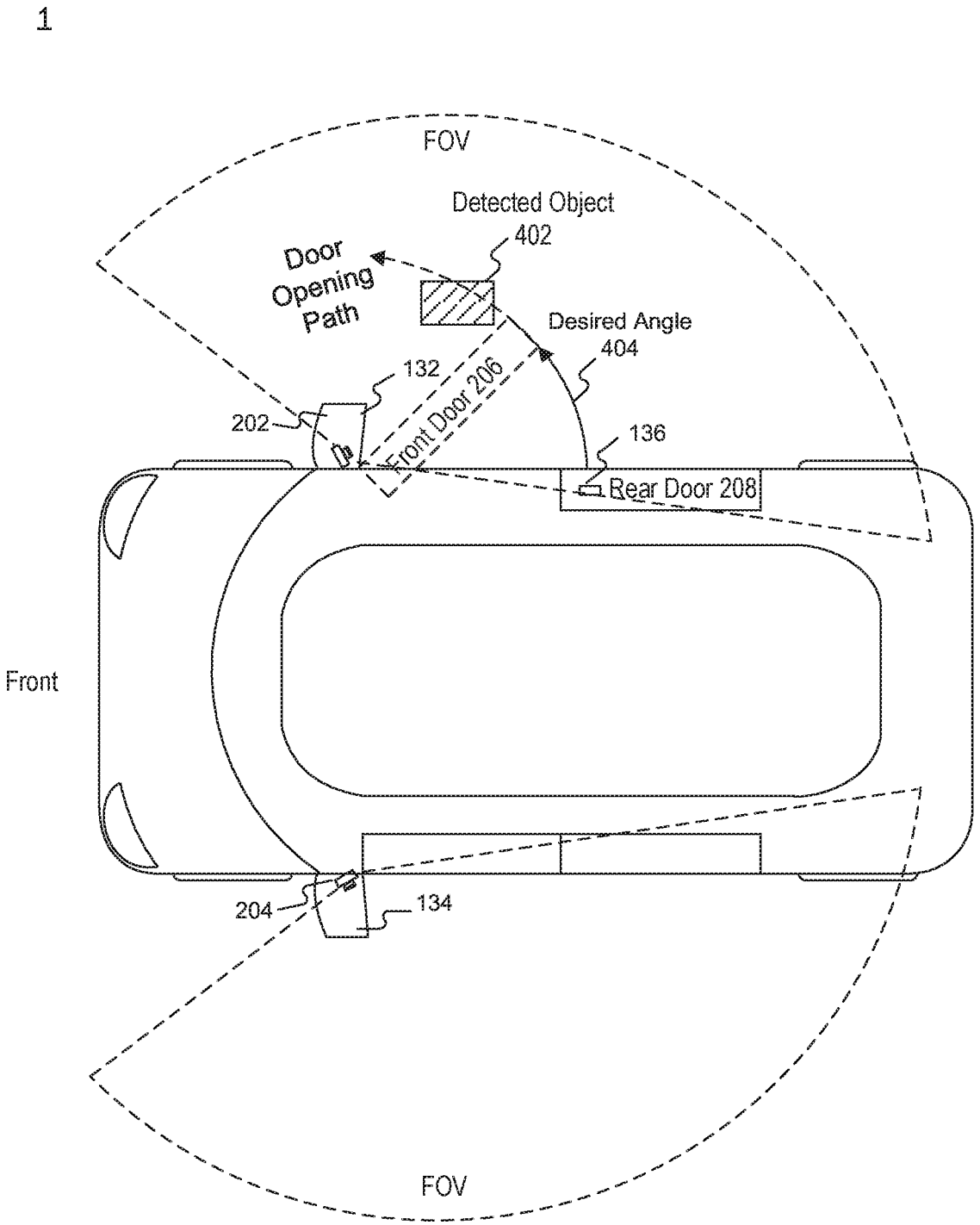
FIG. 4 is a schematic top view illustrating the operation of the exemplary vehicle of FIG. 2.

FIG. 4 is an illustrative schematic top view of vehicle 1 illustrating the operation of vehicle door 3, according to an exemplary embodiment disclosed herein. As illustrated in FIG. 4, controller 100 may detect an object 402 based on the information acquired by sensors 132, 134, and/or 136. Controller 100 may also determine the shape and/or size of object 402 based on the information acquired by the sensors. Controller 100 may further determine a distance between object 402 and a portion of the vehicle (e.g., front door 206). For example, referring FIG. 4, controller 100 may control sensor 136 to determine a distance between the detected object 402 and a portion of the vehicle (e.g., front door 206).

The distance may be used by controller 100 to determine a desired angle 404 to which a door may open. Desired angle 404 of a door may be the second open-door angle, at which the door does not contact object 402.

Figure 5:
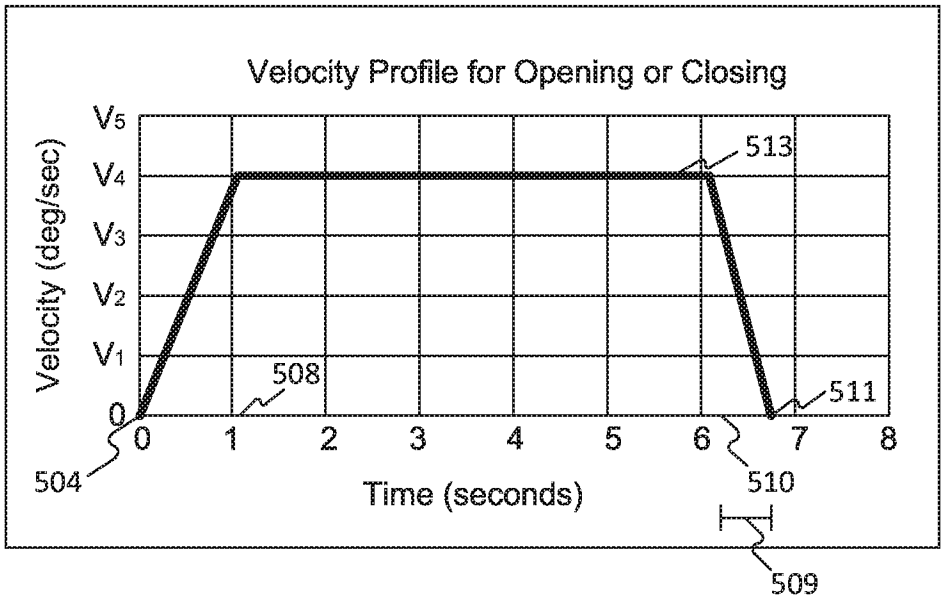
FIG. 5 is a graph illustrating an exemplary velocity profile used by the exemplary system of FIG. 1 for opening or closing of a door of a vehicle.

FIG. 5 is a graph illustrating an exemplary velocity profile 500 used by system 10 of FIG. 1 for opening or closing a door of a vehicle. Velocity profile 500, as discussed above, may be generated based on various attributes (e.g., parameters). Velocity profile 500 may be used to control an actuator to open or close a vehicle's door at particular speeds. An actuator, e.g., actuator 122, may draw various amounts of current in order to move the door at a specific speed. For example, rather than move the door at a constant speed from the time a door begins moving until it stops moving, the door may begin moving slowly, speed up to a target velocity, and then slow down until it stops moving (regardless of whether a door is opening or closing). As illustrated in velocity profile 500, the door may begin moving at start time 504, reach target velocity 513 at start time 504 plus ramp-up time 508, begin slowing down at time to begin ramping down 510, and stop moving at target time to open or close the door 511. In the example illustrated in FIG. 5, the door starts moving at 0 seconds (e.g., start time 504), reaches a velocity of about V4 (e.g., target velocity 513) at about 1.1 seconds (e.g., start time 504 plus ramp-up time 508), begins slowing down at about 6.1 seconds (e.g., time to begin ramping down 510), and stops moving at about 6.7 seconds (e.g., target time to open or close the door 511).

As described herein, various parameters may be stored and/or calculated to generate the exemplary velocity profile 500 shown in FIG. 5. In various embodiments, ramp-up time 508, time to begin ramping down 510, ramp-down time 509, target time to open or close the door 511, and target velocity 513 may be determined based on a first open-door angle, a start velocity, an end velocity, start time 504, a second open-door angle, a ramp-up time percentage of total time to open or close the door, a ramp-down time percentage of total time to open or close the door, and a total time to fully open or close the door.

A first open-door angle may be the maximum angle through which a door pivots relative to a closed door position. A second open-door angle may be the current angle of a door (e.g., if a door is open) or a desired angle (e.g., desired angle 404 of FIG. 4) through which the door pivots to the open position relative to the closed position (e.g., if a door is closed). The desired angle through which the door pivots to the open position relative to the closed position may be based on input acquired from at least one sensor when a door is in a closed position. The desired angle may be an angle at which a door is intended to open such that the door does not contact an object located outside of a vehicle.

A total time to fully open or close the door may be the time it takes for a door to move from a closed position to a first open-door angle or vice-versa. Total time to fully open or close the door may be based on a predetermined time. This predetermined time may be provided to a controller via an I/O device by a user.

A ramp-up time percentage of total time to open or close the door may be a percentage of the total time to fully open or close the door, and/or a percentage of a target time to open or close the door 511. Similarly, a ramp-down time percentage of total time to open or close the door may be a percentage of the total time to fully open or close the door, and/or a percentage of a target time to open or close the door 511. As with total time to fully open or close the door, in various embodiments a ramp-up time percentage of total time to open or close the door and/or a ramp-down time percentage of total time to open or close the door can be based on a predetermined time, which may be provided to a controller via an I/O device by a user.

In the example shown in FIG. 5, target time to open or close the door 511 is based on a product of (1) a total time to fully open or close the door, multiplied by (2) a quotient of (i) a second open-door angle, divided by (ii) a first open-door angle. Thus, target time to open or close the door 511 may be represented by the equation:

$$\text{Total Time to Fully Open or Close the Door} \times \frac{\text{Second Open-Door Angle}}{\text{First Open-Door Angle}} \quad \text{(Equation 1)}$$

Ramp-up time 508 may be based on a product of a ramp-up time percentage of total time to open or close the door multiplied by target time to open or close the door 511. Thus, ramp-up time 508 may be represented by the equation:

$$\text{Ramp-Up Time Percentage of Total Time to Open or Close the Door} \times \text{Target Time to open or close the door 511} \quad \text{(Equation 2)}$$

Ramp-down time 509 may be based on a product of ramp-down time percentage of total time to open or close the door multiplied by target time to open or close the door 511. Thus, ramp-down time 509 may be represented by the equation:

$$\text{Ramp-Down Time Percentage of Total Time to Open or Close the Door} \times \text{Target Time to open or close the door 511} \quad \text{(Equation 3)}$$

Time to begin ramping down 510 may be based on a difference between target time to open or close the door 511 and ramp-down time 509. Thus, time to begin ramping down 510 may be represented by the equation:

$$\text{Target Time to open or close the door 511} - \text{Ramp-Down Time 509} \quad \text{(Equation 4)}$$

Target velocity 513 may be based on a quotient of (1) a product of second open-door angle multiplied by two, divided by (2) a sum of (i) a product of (a) target time to open or close the door 511 minus ramp-down time 509, and minus ramp-up time 508, multiplied by (b) two, plus (ii) ramp-up time 508, plus (iii) ramp-down time 509. Thus, target velocity 513 may be represented by the equation:

$$\frac{\text{Second Open-Door Angle} \times 2}{((\text{Target Time to open or close the door 511} - \text{Ramp-Down Time 509} - \text{Ramp-Up Time 508}) \times 2) + \text{Ramp-Up Time 508} + \text{Ramp-Down Time 509}} \quad \text{(Equation 5)}$$

Figure 6:
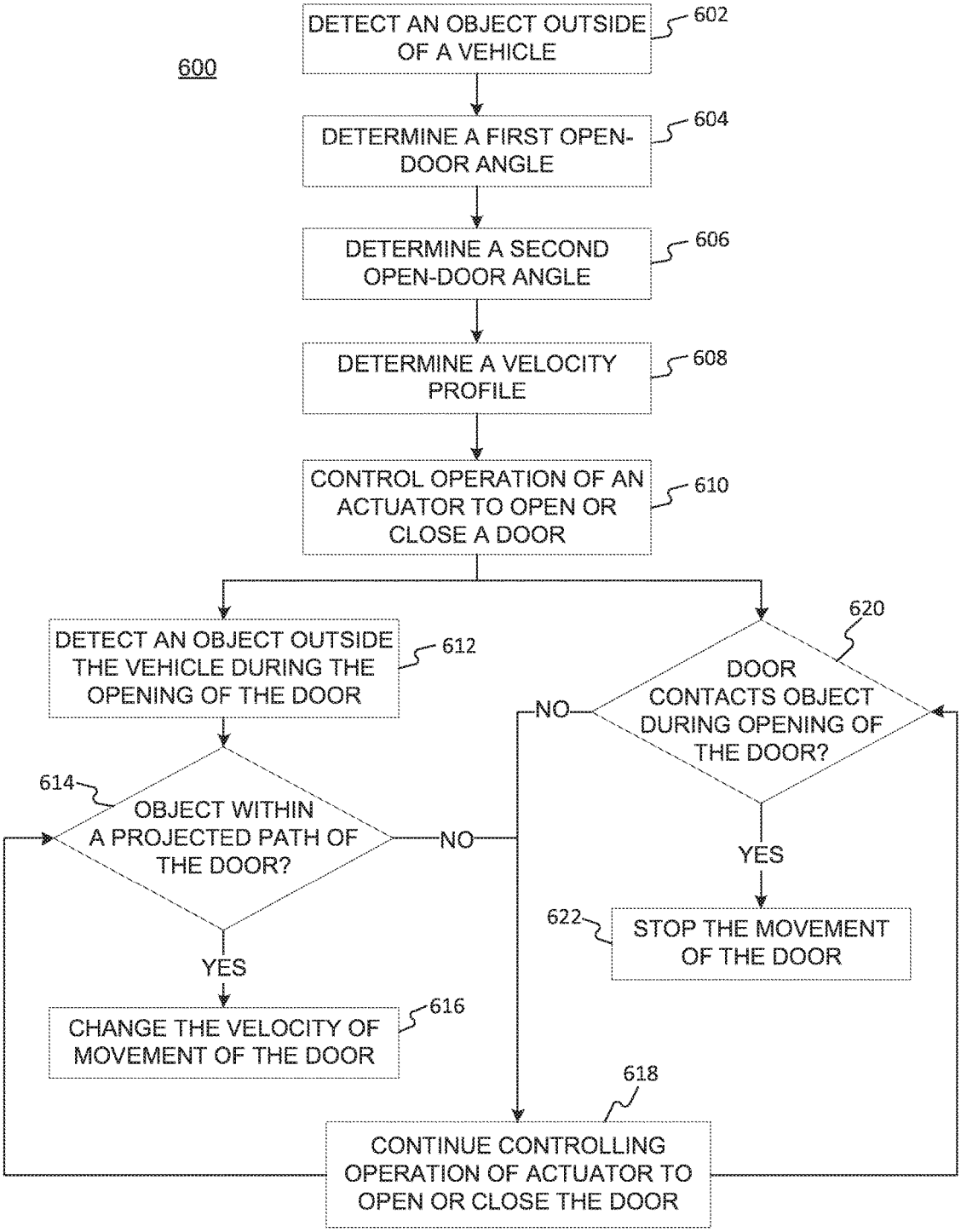
FIG. 6 is a flow chart of an exemplary process that may be performed by the exemplary system of FIG. 1.

FIG. 6 is a flowchart of an exemplary process 600 for opening or closing a door of a vehicle. At 602, sensor 130, 132, 134, and/or 136 may detect whether an object is outside of the vehicle. For example, sensors 130, 132, 134, and/or 136 may detect that object 402 is a particular distance outside of the vehicle. In some embodiments, sensors 130, 132, 134, and/or 136 may detect a size and shape of object 402.

At 604, controller 100 may determine a first open-door angle. A first open-door angle may be a maximum angle through which a door pivots relative to a closed position of the door. For example, a first open-door angle may be the angle at which a door is fully open.

At 606, controller 100 may determine a second open-door angle. A second open-door angle may be: (1) a current angle of a door; or (2) a desired angle through which a door pivots relative to a closed position of the door. A current angle of a door may be used when the door is going to be closed. The desired angle of a door may be used when the door is going to be opened. The desired angle may be based on input from sensors 130, 132, 134, and/or 136 when the door is in the closed position. For example, a sensor may determine that an object is in its field of view (FOV), and a particular distance from a vehicle, and a desired angle (e.g., desired angle 404 of FIG. 4) may be determined such that the door does not contact the object when it reaches desired angle 404.

At 608, controller 100 may determine a velocity profile 500. This determination may be dynamic (e.g., not determined before 608). Velocity profile 500 may be based on a current angle of a door or a desired angle. Velocity profile 500 can be determined based on a first open-door angle, a second open-door angle, and an a total time to fully open or close the door. Velocity profile 500 includes a target time to open or close the door 511 (e.g., the time to move the door from a first position to the desired angle or the time to move the door from a current position to a closed position). The target time to open or close the door 511 may be equal to the total time to fully open the door multiplied by a first open-door angle (e.g., the maximum angle through which a door can pivot relative to a closed position) divided by a second open-door angle (e.g., a desired angle or a current angle), as shown above with reference to Equation 1. A ramp-up time percentage of total time to open or close the door may be used to determine a ramp-up time 508, and a ramp-down time percentage of total time to open or close the door may be used to determine a ramp-down time 509. Based on the ramp-up time 508, the ramp-down time 509, a second open-door angle, and a target time to open or close the door 511, a target velocity 513 may be determined.

At 610, controller 100 may control operation of actuator 122 to open or close front door 206 or rear door 208 according to a first open-door angle, a second open-door angle, and a velocity profile 500. The speed at which actuator 122 is opening or closing a door at a particular point in time may be determined by velocity profile 500. For example, an amount of current drawn by actuator 122 may be determined based on velocity profile 500.

At 612, sensors 130, 132, 134, and/or 136 may detect object 402 outside the vehicle during the opening of the door. During the opening of the door, it is undesirable for the door to contact an object.

At 614, controller 100 may determine whether object 402 is within a projected path of movement of the door. If it is determined that an object is within the projected path (the "YES" arrow out of 614 to 616), the process may proceed to 616. On the other hand, if this condition is not met and no object is determined to be within the projected path (the "NO" arrow out of 614 to 618), the process may proceed to 618.

At 616, controller 100 may control operation of actuator 122. Controller 100 may cause actuator 122 to stop the movement of the door such that the door does not contact object 402 while opening. In some embodiments, protecting mechanism 123 may work in conjunction with controller 100 to stop the door.

At 618, controller 100 may continue to control one or more actuators 122 to move the door to the desired position according to a projected path. While controller 100 continues to control one or more actuators 122 to move the door to the desired position according to a projected path, process 600 may continue to detect whether an object is within a project path of the door at 614, or detect whether a door contacts an object during the opening of the door at 620 (as described below).

At 620, controller 100 may determine whether the door contacts object 402 during the opening of the door. In some embodiments, this determination may be made by protecting mechanism 123, which may detect that the door contacted an object 402 from input from a sensor. For example, this determination may be made by monitoring current, velocity, and/or piezo sensors associated with the door. It is contemplated that in some embodiments protecting mechanism 123 may incorporate piezo sensors, an amount of current associated with actuator 122, and/or a velocity of the door being opened or closed. If it is determined that the door has contacted object 402, this condition is met (the "YES" arrow out of 620 to 622), and the process may proceed to 622. On the other hand, if it is not determined that a door has contacted object 402, this condition is not met (the "NO" arrow out of 620 to 618), and the process may proceed to 618. As discussed above, at 618, controller 100 may continue to control one or more actuators 122 to move the door to the desired position according to a projected path. While controller 100 continues to control one or more actuators 122 to move the door to the desired position according to a projected path, process 600 may continue to detect whether the door contacts an object during the opening of the door at 620. At 620, controller 100 may cause actuator 122 to stop the movement of the door, and/or retract the door such that the actuator does not attempt to move the door further into object 402.

According to some embodiments, the systems and methods described herein may be used to open and close a vehicle door. According to some embodiments, the systems and methods may control operation of actuators for opening and closing a vehicle door such that shaking or jittering of the door during movement is reduced or eliminated.

It will be apparent to those skilled in the art that various modifications and variations can be made to the disclosed systems and methods. Other embodiments will be apparent to those skilled in the art from consideration of the specification and practice of the systems and methods. It is intended that the specification and examples be considered as exemplary only, with a true scope being indicated by the following claims and their equivalents.

What is claimed is:

1. A system for operating a door of a vehicle, the system comprising:

an actuator configured to move the door between an open position and a closed position; and a controller configured to:

determine a first open-door angle associated with a predetermined first velocity profile;

determine a second open-door angle based on the open position relative to the closed position;

determine a second velocity profile based on the first open-door angle, the second open-door angle, and the first velocity profile; and control the actuator to operate the door according to the second velocity profile.

2. The system of claim 1, wherein the first open-door angle is a maximum angle through which the door pivots relative to the closed position.

3. The system of claim 1, wherein the second open-door angle is a current angle of the door and wherein the controller is configured to control the actuator to close the door according to the second velocity profile.

4. The system of claim 1, wherein the second open-door angle is a desired angle through which the door pivots to the open position relative to the closed position, and wherein the controller is configured to control the actuator to open the door according to the second velocity profile.

5. The system of claim 4, further comprising at least one sensor configured to detect an object outside the vehicle, wherein the desired angle is determined based on input from the at least one sensor when the door is in the closed position.

6. The system of claim 5, wherein the controller is configured to control the actuator to change a velocity of the door if the object is detected to be within a projected path of the door during opening of the door.

7. The system of claim 1, wherein the controller is configured to control the actuator to change a velocity of the door if the door contacts an object during opening of the door.

8. The system of claim 1, wherein the second velocity profile is based on the first open-door angle, the second open-door angle, a target time to open or close the door, a ramp-up time, a ramp-down time, a time to begin ramping down, and a target velocity.

9. The system of claim 8, wherein the second velocity profile is further based on a total time to fully open or close the door, a ramp-up time percentage of total time to open or close the door, and a ramp-down time percentage of total time to open or close the door, determined from the first velocity profile.

10. A method for operating a door of a vehicle between an open position and a closed position, the method comprising:

determining, by a controller, a first open-door angle associated with a predetermined first velocity profile;

determining, by the controller, a second open-door angle based on the open position relative to the closed position;

determining, by the controller, a second velocity profile based on the first open-door angle, the second open-door angle, and the first velocity profile; and operating the door, by an actuator, according to the second velocity profile.

11. The method of claim 10, wherein the first open-door angle is a maximum angle through which the door pivots relative to the closed position.

12. The method of claim 10, wherein the second open-door angle is a current angle of the door, and wherein operating the door includes closing the door according to the second velocity profile.

13. The method of claim 10, wherein the second open-door angle is a desired angle through which the door pivots to the open position relative to the closed position, and wherein operating the door includes opening the door according to the second velocity profile.

14. The method of claim 13, further comprising detecting, by at least one sensor, an object outside the vehicle, wherein the desired angle is determined based on input from the at least one sensor when the door is in the closed position.

15. The method of claim 14, further comprising changing a velocity of the door if the object is detected to be within a projected path of the door during opening of the door.

16. The method of claim 13, wherein the second velocity profile is based on the first open-door angle, the second open-door angle, a target time to open or close the door, a ramp-up time, a ramp-down time, a time to begin ramping down, and a target velocity.

17. The method of claim 16, wherein the second velocity profile is further based on a total time to fully open or close the door, a ramp-up time percentage of total time to open or close the door, and a ramp-down time percentage of total time to open or close the door, determined from the first velocity profile.

18. The method of claim 10, further comprising changing a velocity of the door if the door contacts an object during opening of the door.

19. A vehicle, comprising:

a door;

an actuator configured to move the door between an open position and a closed position; and a controller configured to:

determine a first open-door angle associated with a predetermined first velocity profile;

determine a second open-door angle based on the open position relative to the closed position;

determine a second velocity profile based on the first open-door angle, the second open-door angle, and the first velocity profile; and control the actuator to operate the door according to the second velocity profile.

20. The vehicle of claim 19, further comprising at least one sensor configured to detect an object outside the vehicle, wherein the second open-door angle is determined based on input from the at least one sensor when the door is in the closed position.

* * * * *